United States Patent [19]

Niu

[11] Patent Number: 4,490,275

[45] Date of Patent: Dec. 25, 1984

[54] METHOD AND COMPOSITION FOR NEUTRALIZING ACIDIC COMPONENTS IN PETROLEUM REFINING UNITS

[75] Inventor: Joseph H. Y. Niu, Houston, Tex.

[73] Assignee: Betz Laboratories Inc., Trevose, Pa.

[21] Appl. No.: 540,217

[22] Filed: Oct. 7, 1983

Related U.S. Application Data

[62] Division of Ser. No. 479,386, Mar. 28, 1983, Pat. No. 4,430,196.

[51] Int. Cl.[3] ..... C09K 3/00

[52] U.S. Cl. ..... 252/189; 252/390

[58] Field of Search ..... 252/390, 391, 392, 189

[56] References Cited

U.S. PATENT DOCUMENTS 3,897,349 7/1975 Marin et al. ..... 252/392

*Primary Examiner*—Ben R. Padgett
*Assistant Examiner*—T. J. Wallen
*Attorney, Agent, or Firm*—Alexander D. Ricci; Bruce E. Peacock

[57] ABSTRACT

Methods and compositions are disclosed for neutralizing acidic components in petroleum refining units. The neutralizing agent comprises a member selected from the group of dimethylaminoethanol and dimethylisopropanolamine. The neutralizing agent may be added directly to the charge, in a reflux line, or directly to the overhead line of the refining unit. In those instances in which sour crude is to be refined, it is desirable that dimethylisopropanolamine be used in conjunction with the dimethylaminoethanol. The neutralizing agents are added in an amount sufficient to elevate the pH of the condensate (as measured at the accumulator) to within the pH range of 4.5–7.

3 Claims, No Drawings

METHOD AND COMPOSITION FOR NEUTRALIZING ACIDIC COMPONENTS IN PETROLEUM REFINING UNITS

This is a division of application Ser. No. 479,386 filed on Mar. 28, 1983, now U.S. Pat. No. 4,430,196.

FIELD OF THE INVENTION

The present invention pertains to a method and composition for neutralizing acidic components in petroleum refining units without resulting in significant fouling of the apparatus.

BACKGROUND

Hydrocarbon feedstocks such as petroleum crudes, gas oil, etc. are subjected to various processes in order to isolate and separate different fractions of the feedstock. In refinery processes, the feedstock is distilled so as to provide light hydrocarbons, gasoline, naptha, kerosene, gas oil, etc.

The lower boiling fractions are recovered as an overhead fraction from the distillation zones. The intermediate components are recovered as side cuts from the distillation zones. The fractions are cooled, condensed, and sent to collecting equipment. No matter what type of petroleum feedstock is used as the charge, the distillation equipment is subjected to the corrosive activity of acids such as $H_2S$, HCl, and $H_2CO_3$.

Corrosive attack on the metals normally used in the low temperature sections of a refinery process system, i.e. (where water is present below its dew point) is an electrochemical reaction generally in the form of acid attack on active metals in accordance with the following equations:

(1) at the anode:

$$Fe \rightleftarrows Fe^{++} + 2(e)$$

(2) at the cathode:

$$2H^{+} + 2(e) \rightleftarrows 2H$$

$$2H \rightleftarrows H_2$$

The aqueous phase may be water entrained in the hydrocarbons being processed and/or water added to the process for such purposes as steam stripping. Acidity of the condensed water is due to dissolved acids in the condensate, principally HCl and $H_2S$ and sometimes $H_2CO_3$. HCl, the most troublesome corrosive material, is formed by hydrolysis of calcium and magnesium chlorides originally present in the brines produced concomitantly with the hydrocarbons, oil, gas, condensates.

Corrosion may occur on the metal surfaces of fractionating towers such as crude towers, trays within the towers, heat exchangers, etc. The most troublesome locations for corrosion are the overhead of the distillation equipment which includes tower top trays, overhead lines, condensers, and top pump around exchangers. It is usually within these areas that water condensation is formed or is carried along with the process stream. The top temperature of the fractionating column is maintained about at or above the boiling point of water. The condensate formed after the vapor leaves the column contains significant concentration of the acidic components above-mentioned. This high concentration of acidic components renders the pH of the condensate highly acidic and, of course, dangerously corrosive. Accordingly, neutralizing treatments have been used to render the pH of the condensate more alkaline to thereby minimize acid-based corrosive attack at those apparatus regions with which this condensate is in contact.

Prior art neutralizing agents include ammonia, morpholine, cyclohexylamine, diethylaminoethanol, monoethanolamine, ethylenediamine and others. U.S. Pat. No. 4,062,764 (White et al) suggests that alkoxylated amines, specifically methoxypropylamine, may be used to neutralize the initial condensate. U.S. Pat. No. 3,779,905 (Stedman) teaches that HCl corrosion may be minimized by injecting, into the reflux line of the condensing equipment, an amine containing at least seven carbon atoms. Other U.S. patents which may be of interest include U.S. Pat. Nos. 2,614,980 (Lytle); 2,715,605 (Goerner); and 2,938,851 (Stedman).

The use of such prior art neutralizing agents has not been without problem, however, For instance, in many cases the hydrochloride salts of neutralizing amines form deposits in the equipment which may result in the system being shut down completely for cleaning purposes. Also, as the use of sour crudes has increased, in many cases the neutralizing agent has demonstrated an affinity to form the sulfide salt, thus leaving the more corrosive HCl, unreacted in the condensate and causing severe corrosion.

Accordingly, there is a need in the art for a neutralizing agent which can effectively neutralize the condensate in refinery systems without resulting in excessive system fouling. There is a further need for such a neutralizing treatment which can function effectively in those systems charged with a high sulfur content feedstock.

DESCRIPTION OF THE INVENTION

The invention comprises the discovery that the use of a member or members selected from the group of dimethylaminoethanol (DMAE) and dimethylisopropanolamine (DMIPA) effectively neutralizes the condensate without resulting in appreciable deposit formation. In those instances in which sour crudes are to be refined, the dimethylisopropanolamine (DMIPA) amine is used in combination with the DMAE. In these "sour crude" applications, the DMIPA selectively neutralizes the HCl component of the crude instead of the $H_2S$ component. In this manner, the DMIPA is not consumed by the $H_2S$ so that the more serious corrosive material, HCl, can be neutralized.

By use of the phrase "condensate," I refer to the environment within the distillation equipment which exists in those system loci where the temperature of the environment approaches the dew point of water. At such loci, a mixed phase of liquid water, hydrocarbon, and vapor may be present. It is most convenient to measure the pH of the condensate at the accumulator boot area.

The phrase "sour crude" is used to refer to those feedstocks containing sufficient amount of $H_2S$, or compounds reverting to $H_2S$ upon heating, which result in 50 ppm or greater of $H_2S$ in the condensate (as measured at the accumulator).

The treatment may be injected into the charge itself, the overhead lines, or reflux lines of the system. It is preferred to feed the neutralizing treatment directly to the charge so as to prevent the deleterious entrance of HCl into the overhead as much as possible.

The treatment is fed to the refining unit, in which distillation is taken place, in an amount necessary to maintain the pH of the condensate within the range of about 4.5–7, with a pH range of 5–6 being preferred. In those instances in which the combined DMAE/DMIPA treatment is desirable, the weight ratio of the DMAE:DMIPA fed may be within the range of 1–10:-10–1. The preferred weight ratio of DMAE:DMIPA, in the combined treatment, is about 3:1. In those instances in which the combined treatment is desirable, the DMAE and DMIPA components may be fed separately or together.

The DMAE and/or DMIPA components are readily available from various commercial sources. Also, they may be prepared by reacting ethylene oxide or propylene oxide with aqueous dimethylamine.

As has been previously indicated, the use of the DMAE/DMIPA combination is preferred for sour crude charges. Quite surprisingly, it has been discovered that the DMIPA component does not react with $H_2S$ to any significant extent, thus allowing it to function primarily in neutralizing the HCl component. At the same time, the DMAE component provides its excellent neutralizing and low fouling characteristics to the combination. For use in conjunction with such sour crudes, an aqueous composition having a weight ratio DMAE:DMIPA equal 3:1 is preferred.

A minor amount of a chelant such as $EDTA.Na_4$ may be incorporated in the composition so as to sequester any hardness present in the water. In this manner, the stability of the product is enhanced so that the combined treatment may readily be sold in a single drum.

EXAMPLES

The invention is further illustrated by the following examples and field test examples which are intended merely for the purpose of illustration and are not to be regarded as limiting the scope of the invention or the manner in which it is to be practiced.

The boiling point of a neutralizer and the melting point of its hydrochloride salt are thought important in the selection of an optimum neutralizer. In the crude charge, an amine neutralizer should have a boiling point low enough to be able to vaporize and condense in the distillation overhead (37°–150° C.) to maintain proper pH control. If the boiling point of the amine is too high, the amine may leave in one of the side cuts unreacted, or may form a salt that could foul the pumparounds or reboiler.

With regard to amine salts in general, the lower the melting point of the amine, the greater the dispersibility in the hydrocarbon fluid. A liquid salt is more likely to be dispersed than a solid salt, especially at higher temperatures where its viscosity will be considerably lowered.

EXAMPLE 1

In order to prepare the requisite amine hydrochloride salts for melting point testing, 10 grams of the amine were placed in a solvent such as toluene or petroleum ether. HCl gas was then bubbled into the solution at a rate of about 0.5 l.p.m. for 15–20 minutes. The resulting precipitate formed was filtered and washed with a low boiling solvent. It was then dried under vacuum and weighed. In the case of a soluble salt, the solution was first subjected to water aspirator vacuum to remove unreacted HCl as well as the low boiling solvent such as petroleum ether. The higher boiling solvent such as toluene was removed with a rotovap under high vacuum.

Results of the boiling point tests and amine hydrochloride salt melting point tests are contained in Table 1.

TABLE I

| Amine | B. Point (°C.) | M. Point (°C.) HCl Salt |
|---|---|---|
| DMIPA | 121–127 | 110–113 |
| DMAE | 139 | 52–62 |
| DEAE | 161 | 130–135 |
| MOPA | 116–123 | 93–97 |
| Cyclohexylamine | 134 | 205 |
| Ethylenediamine | 118 | 300 |
| Morpholine | 129 | 175–178 |

DEAE = diethylaminoethanol
MOPA = methoxypropylamine

EXAMPLE 2

Five grams of the desired amine were dissolved in 45 g of an organic solvent (i.e., petroleum ether) in which the amine hydrosulfide salt was insoluble. One flask was fitted with an ice water condenser to prevent evaporation of the low boiling solvent. Hydrogen sulfide was passed into the solution at a fixed rate (0.5–0.6 lpm) for fifteen minutes at a set temperature. If no precipitate was observed, an extra fifteen minutes of gas flow was allowed. When higher temperatures were used, the final solution was cooled to room temperature or to 0° C. to observe any precipitation. Additional solvent was added to make up for any loss through evaporation. The amount of solids or liquid precipitated out of the solvent was also weighed and the approximate amount of amine reacted was calculated. The results are given in Table 2.

TABLE 2

| Amine | 0° C. PPTn | 25° C. PPTn | 50° C. PPTn | 85° C. PPTn |
|---|---|---|---|---|
| DMAE | 100 | 30 | 0 | 0 |
| DEAE[1] | 60 | 20 | 0 | 0 |
| DMIPA | 0 | 0 | 0 | 0 |
| MOPA[2] | 100 | 90 | 60 | 10 |

[1] = diethylaminoethanol
[2] = Methoxypropylamine - see U.S. Pat. 4,062,764

EXAMPLE 3

In order to determine the fouling tendencies of the amines, the relative dispersibility and stability of the salts of individual amines in hydrocarbon fluid were determined. If an amine salt is nonsticking to metals and is easily dispersed in the fluid, it will be less inclined to deposit onto the metal. As such, the fouling tendencies of each of the amines can therefore be determined.

The study involved the comparison of the relative stickiness of the salts onto carbon steel and brass surfaces in HAN or kerosene within the temperature range of 215°–225° C. This was accomplished by heating 5–7 g. of the amine salt in approximately 150 ml of solvent in a three necked flask fitted with a stirrer, a thermometer and a condenser. The metal to be studied was cut into the shape of a stirrer blade and replaced the teflon blade normally used. The mixture was stirred and heated to reflux temperature and was maintained for 15 minutes. After this time period, the apparatus was disassembled and the blade visually examined. The "fouling rating" was determined in accordance with the amount of salt sticking to the blade. The "fouling ratings" were determined by the following:

| | | |
|---|---|---|
| VG-G (Very Good to Good) | little to some sticking on the blade | |
| G-F (Good to Fair) | some sticking, the agglomeration covering one-half of the blade or less | |
| F-B (Fair to Bad) | sticky deposit covering more than half of the blade | |
| B (Bad) | heavy deposit covering all of the blade | |
| Results were as follows | (K = kerosene, HAN = high aromatic naptha) | |
| Amine - HCl (salts) | Dispersibility | |
| | Carbon Steel | Brass |
| DMIPA | VG-G (K) G-F (HAN) | VG-G (K) |
| DMAE | VG-G (K) VG-G (HAN) | VG-G (K) |
| DEAE | VG-G (K) VG-G (HAN) | VG-G (K) |
| MOPA | VG-G (K) VG-G (HAN) | VG-G (K) |
| Morpholine | F-B (K) (HAN) | F-B (K) |

Discussion

Example 1 indicates that all of the tested amines (with the exception of DEAE) were suitable with respect to their boiling point characteristic. Since the boiling point of DMIPA, DMAE, MOPA, cyclohexylamine, ethylenediamine and morpholine each fell within the acceptable range (37°-150° C.), each of these amines would properly vaporize and condense in the distillation overhead so as to provide protection against HCl, $H_2S$ and $CO_2$ based corrosion which, in untreated systems, is usually abundant at those system locations wherein condensate is formed or carried.

The melting point of DMAE.HCl salt is significantly lower than the other amines tested. This tends to indicate that DMAE is more readily dispersed throughout the hydrocarbon fluid, thus increasing neutralizing efficacy.

Example 2 indicates that DMAE, MOPA, and DEAE react with $H_2S$ to form the corresponding amine.$H_2S$ salt. Surprisingly, DMIPA does not so react. This factor is important, especially in those situations wherein the crude charge contains $H_2S$ or organic sulfur compounds which would form $H_2S$ upon heating. It has been found that the most deleterious corrosive material in refining systems is HCl. Accordingly, the use of DMIPA as a neutralizer in such $H_2S$ containing systems is desirable as this particular amine is selective in its salt reaction formation, not reacting with $H_2S$ to any significant extent, but remaining available for the all important HCl neutralization.

Example 3 indicates that the fouling tendencies of DMIPA.HCl, and DMAE.HCl, salts are comparable to the prior art DEAE and MOPA neutralizers. All of these amines perform considerably better than the prior art morpholine.

Accordingly, DMAE is a highly desirable neutralizing agent because of its satisfactory fouling tendencies and its ready dispersibility in the particular hydrocarbon fluid. DMIPA is an effective neutralizer, especially in those high $H_2S$ containing crudes since this particular amine is selective in its salt formation reaction towards HCl neutralization.

Field Tests

In order to test the effectiveness of the above laboratory findings which indicate the effectiveness of DMAE-DMIPA neutralizers, an aqueous composition comprising a 3:1 weight ratio of DMAE:DMIPA was utilized.

At one west coast refinery, where a sour crude was being processed, this DMAE/DMIPA neutralizing composition was found to exhibit approximately 30% more neutralization strength than the use of an aqueous composition comprising (weight basis) monoethanolamine 23.5%, 14% DMIPA, remainder water.

At a Gulf Coast refinery location, the performance of the above DMAE/DMIPA treatment was contrasted to a prior art neutralizing aqueous composition comprising monoethanolamine, and ethylenediamine. Based upon laboratory titrations, the DMAE/DMIPA neutralizer was thought to be about 60% weaker than the MEA/EDA neutralizer. However, both of these neutralizing treatments maintained proper pH control at a rate of about 65-75 gallons per day when used at the refinery.

I claim:

1. Aqueous composition for neutralizing acidic components of a distilling petroleum product consisting essentially of dimethylaminoethanol (DMAE) and dimethylisopropanolamine (DMIPA), said DMAE and DMIPA being present, on a weight basis, in a ratio of about 1-10:10-1 DMAE:DMIPA.

2. Composition as recited in claim 1 wherein said DMAE and said DMIPA are present, on a weight basis, in a ratio of about 3:1 DMAE:DMIPA.

3. Composition as recited in claim 1 further comprising water.

* * * * *